US005551542A

United States Patent [19]

Stockli

[11] Patent Number: 5,551,542

[45] Date of Patent: Sep. 3, 1996

[54] PROCESS AND APPARATUS FOR IDENTIFYING COINS

[76] Inventor: Rudolf Stockli, Gallusstrasse 36, 4600 Olten, Switzerland

[21] Appl. No.: 357,253

[22] Filed: Dec. 13, 1994

[30] Foreign Application Priority Data

Dec. 13, 1993 [CH] Switzerland ..... 03 703/93

[51] Int. Cl.[6] ..... G07D 5/02; G07D 3/12

[52] U.S. Cl. ..... 194/334; 453/4; 453/57

[58] Field of Search ..... 453/4, 12, 13, 453/49, 57, 58; 194/302, 303, 317, 318, 328, 330, 334

[56] References Cited

U.S. PATENT DOCUMENTS

| | | | |
|---|---|---|---|
| 3,371,761 | 3/1968 | Hirano | 194/334 X |
| 3,680,566 | 8/1972 | Tanaka et al. | 453/4 |
| 3,754,558 | 8/1973 | Conant et al. | 453/58 |
| 3,939,954 | 2/1976 | Collins | 453/58 X |
| 4,147,175 | 4/1979 | Webb | 453/58 X |
| 4,881,918 | 11/1989 | Goh et al. | 194/334 X |
| 5,040,657 | 8/1991 | Gunn et al. | 194/317 |
| 5,067,604 | 11/1991 | Metcalf | 194/318 X |
| 5,392,891 | 2/1995 | Ferguson et al. | 194/317 |

FOREIGN PATENT DOCUMENTS

| | | | |
|---|---|---|---|
| 0209675 | 1/1987 | European Pat. Off. . | |
| 0269690 | 6/1988 | European Pat. Off. . | |
| 3325486 | 1/1984 | Germany . | |
| 2128795 | 5/1984 | United Kingdom . | |
| 2135492 | 8/1984 | United Kingdom . | |
| 2203582 | 10/1988 | United Kingdom . | |
| 9007164 | 6/1990 | WIPO | 194/334 |
| WO94/11847 | 5/1994 | WIPO . | |

*Primary Examiner*—Karen B. Merritt
*Assistant Examiner*—Scott L. Lowe
*Attorney, Agent, or Firm*—Oblon, Spivak, McClelland, Maier & Neustadt, P.C.

[57] ABSTRACT

In order to identify coins, the coins are separated by a separating device which is designed as a rotatable perforated disc. Subsequently, an identification measurement is carried out as long as the coins are still located in the perforations of the perforated disc. In order to carry out the measurement, use may be made, for example, of a light barrier or an inductive or capacitive sensing device. By way of a positioning device, which has an accelerating or decelerating effect on the coins located in the perforations, the coins are held in a specific, precisely defined position during the measurement.

34 Claims, 13 Drawing Sheets

PROCESS AND APPARATUS FOR IDENTIFYING COINS

BACKGROUND OF THE INVENTION

1. Field of the Invention

The present invention relates to a process and to an apparatus for identifying coins in which the coins are separated by a separating device.

2. Discussion of the Background

A process and an apparatus of this type are known from GB-A-2 128 795. In the case of this solution, the side borders of the receiving compartments, which are open towards the circumference of the disc, converge towards the center of the disc. This measure means that the coins are held in an accurately defined measuring position during the measurement, irrespective of their size. Upon running through two stationary measuring stations, the size, i.e. the diameter, of the coins is sensed. For this purpose, use is made, at each measuring station, of a light-barrier arrangement having a number of light barriers which are arranged along a radially running line. Depending on the size of the coins, more or less light barriers are interrupted when the coins run past the measuring stations. The coin sizes are determined in an evaluation unit from the resulting signals. In this arrangement, the disc is rotated in steps in time with the operation of the evaluation unit.

In the case of this known apparatus, the measurement and evaluation electronics are comparatively high in outlay. In addition, the clock-governed mode of operation of this apparatus rules out very high operating speeds.

It is also known to identify coins in a manner other than by means of measurement of their dimensions. For example, GB-A-2 135 492 describes a process for detecting coins, in the case of which process an eddy current is induced in the respective coin, the decay of the eddy current is monitored, and the resulting actual value is then compared with a desired value, the respective coin being detected upon correspondence of the compared values.

SUMMARY OF THE INVENTION

An object of the present invention is to provide for a process and an apparatus for identifying coins, which process and apparatus are capable of reliably carrying out the identification at high speed and with a low degree of outlay.

For example, the measurement can be carried out in that a light beam of a light barrier which comprises an optical transmitter and optical receiver is directed onto a disc, in the region of receiving compartments, and in that, from the signals of the optical receiver, conclusions are drawn as to the size of the individual coins contained in the receiving compartments of the disc.

In the case of receiving compartments in the form of perforations, the light beam of the light barrier can be directed onto a location which is located radially within or outside the path which is described by the geometrical centers of the perforations of the perforated disc. Use may also be made, in the apparatus according to the invention, of other sensing devices, for example an inductive and/or capacitive sensing device.

Since the measurement takes place when the coins are present in a state in which they are separated in the disc, additional outlay for fitting a measuring device downstream of the disc is dispensed with.

Preferably, the receiving compartments of the disc are selected to be larger than the diameter of the largest expected coins, but advantageously smaller than double the diameter of the smallest expected coin, and a measurement along a chord of the respective coins located in the receiving compartments is carried out by means of the light beam. The individual coins in the respective receiving compartments thus influence the light beam of the light barrier with their front edge and with their rear edge. If the light barrier is produced as a transmission light barrier, i.e. with the optical transmitter on one side of the disc and with the optical receiver on the other side of the disc, then the light beam, which extends initially through the free space between the border of the receiving compartment and the front edge of the coin, is interrupted by the front edge and is then released again by the rear edge of the coin. The measure of the distance between the corresponding falling edge, and the subsequent rising edge, of the signal of the light barrier is a measure for a chord length of the coin, and this chord length is characteristic for a specific coin type which is located in the receiving compartment of the disc.

Instead of, or in addition to, the measurement which has just been described, there is also the possibility of carrying out a measurement of the clearance between the respective border of the receiving space and the front edge of the coin. In addition to this, or as an alternative to this, there is also the possibility of measuring the size of the corresponding clearance between the rear edge of the respective coin and the border of the receiving space. Each of these three measurements, or combinations thereof, can be used to identify individual coins since the measured values are characteristic for the respective coin sizes. Since it cannot be ruled out that, for example, a genuine coin and an unacceptable coin are of the same size, use may, if appropriate, also be made of further measuring results, for example measuring results produced by measuring the alloy, thickness, relief, image, grooves, in order to distinguish between the genuine coins and unacceptable coins. These further measuring results can be produced in a conventional manner, it likewise being possible to carry out at least some of the above-mentioned measurements while the coins are located in the disc.

Unfortunately, however, as soon as the disc moves non-uniformly, the coins are no longer located correctly in the receiving compartments, and this can lead to errors in measurement. A check can be effected by carrying out the measurement of the second clearance. As in the case of the measurement of the first clearance, this also results in a characteristic value. If both measured values then indicate the same diameter, it can, in practice, be assumed that the disc and thus the coins in the measuring area have advanced largely uniformly. However, this is not unconditionally the case since the coins rock back and forth.

The measurement of one clearance and the measurement of the chord of the coin is likewise conceivable. The measurement of the two clearances and the measurement of the chord can be described as an optimum method. In this case, three values have to indicate the same diameter in order to identify a coin satisfactorily. This, however, requires a relatively high degree of outlay in terms of electronics since the computer is concerned with defining the diameter over the entire measuring area.

There is a possibility of carrying out the measurement as a time measurement, this type of measurement then necessitating the speed of rotation of the perforated disc to remain constant during the measurement. This may, if appropriate, be checked and, for the further evaluation, use is made only of such measurements in the case of which said criterion is fulfilled. Coins which have not been satisfactorily detected or coins in the case of which the measurement, as a result of changing speed of the disc, for example upon switching on the apparatus, is incomplete can be ejected out of the disc and re-fed for renewed measurement.

The measurement may also, however, be carried out as a measurement of displacement, use being made of a measuring device, for example an incremental transducer, which is coupled directly or indirectly to the disc, with the result that a specific rotation of the disc also results in a corresponding movement of the displacement-measuring device. The displacement-measuring signals of the displacement-measuring device may then be used to evaluate the distance between the corresponding edges of the light-barrier signal, as a result of which the measurement is then independent of changes or fluctuations in the speed of rotation.

It is not absolutely necessary to define the beginning or the end of the measurement by the determination of the front or rear border of the receiving compartments by means of the light beam, for this can also be achieved by a different signal, for example a signal which marks this border or a starting point adjacent to this.

A corresponding signal can be generated by the sensing of markings on the disc and/or on the border of the disc. These markings may also, however, be read off the displacement-measuring device, for example the resolution of the displacement-measuring device may be such that every thousandth pulse marks the border of a receiving compartment at the point of intersection with the light beam or marks an adjacent point which, in the same way, can be used for the measurement.

It is also possible to define measuring-time windows, during which the receiving compartments of the disc move through the light beam, and to define only such measuring signals as arise during these measuring-time windows.

In order to stabilize the position of the coins in the receiving compartments of the disc, use may also be made of a perforation shape which is other than circular, for example a perforation shape having two straight sides which converge in the direction of rotation of the disc or counter to this.

It generally applies, in the case of the process according to the invention and in the case of the apparatus according to the invention, that all the measurements which do not result in a satisfactory identification of a respective coin are utilized to send the coins back, by means of a corresponding ejecting device, into a collecting hopper which feeds the disc, with the result that the coin is once again received by the disc and measured.

Although the process and the apparatus according to the invention permit a clear detection of unacceptable coins, it is always conceivable that the measurement has taken place under irregular conditions, which may possibly not be satisfactorily recognized as being clear, with the result that the reliability of the measurement is to be doubted. For this reason, an unacceptable coin is not sent directly into an unacceptable-coin compartment, but is first of all guided back into the hopper.

Consequently, at the end of a measuring series, the concentration of unacceptable coins increases, with the result that a plurality, for example two, three or more, unacceptable coins are detected directly one after the other. This can be used to ascertain that the measurements have taken place reliably under regular conditions and the coins are actually unacceptable. These unacceptable coins may then be separated out into the unacceptable-coin compartment or be singled out for closer inspection.

By means of this process and this apparatus, the unacceptable coins are not detected to a better and more satisfactory extent by way of ever-increasing outlay, but they are fed for a renewed diameter test, which, overall, constitutes a reduced degree of outlay.

After the identification of the individual coins in the perforated disc, the coins may, as described, for example, in EP-A-209 675, be fed to a sorting section or, simply as a result of the identification and the number of the respective coins, the overall value of the coins can be detected without sorting.

Accordingly, the present invention relates to a process for identifying coins. The process comprises the steps of separating coins with a separating device, wherein the separating device comprises a rotatable disc having receiving compartments for individual coins; accelerating or decelerating the rotatable disc so as to move the separated coins into a specific position of an associated receiving compartment such that in said position, the separated coins abut against a border of the receiving compartment; and identifying the separated coins by at least one measurement while the separated coins are located within the receiving compartments and held in the said position.

The present invention also relates to an apparatus for identifying coins. The apparatus comprises a separating device including a perforated rotatable disc provided with receiving compartments; a sensing device for measuring a property of the coins, the sensing device being arranged in a region of a path defined by the receiving compartments upon a rotation of the perforated disc; a computing device for determining a size and/or identity of respective coins from signals from the sensing device as a result of a presence of a coin in an associated receiving compartment; and a positioning device having an accelerating or decelerating effect on respective coins arranged in the receiving compartments of the perforated disc and moves the coins, at least in a region of the sensing device, into abutment against a border of the associated receiving compartment.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
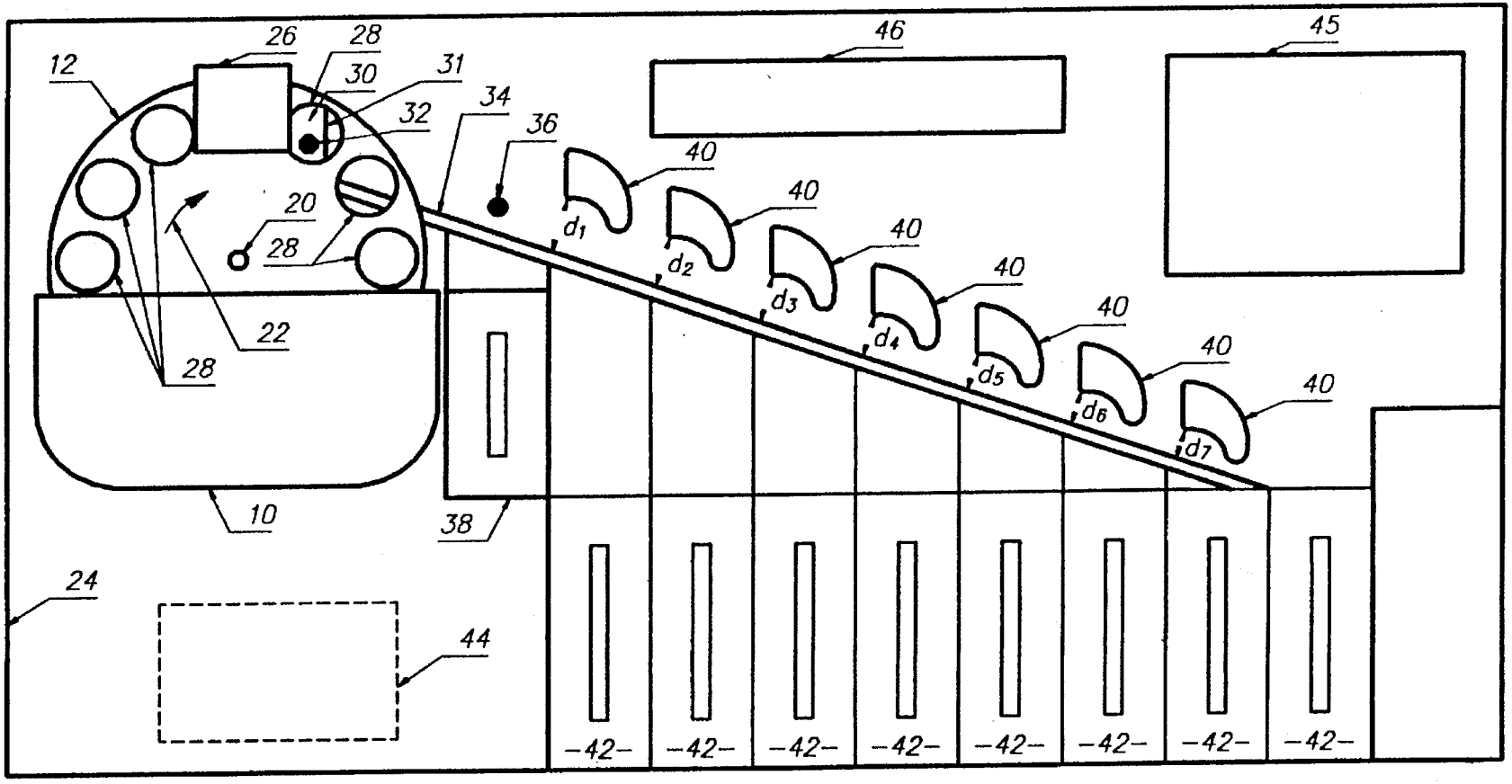
FIG. 1 shows a coin-identifying and -sorting device according to the invention.
Figure 2:
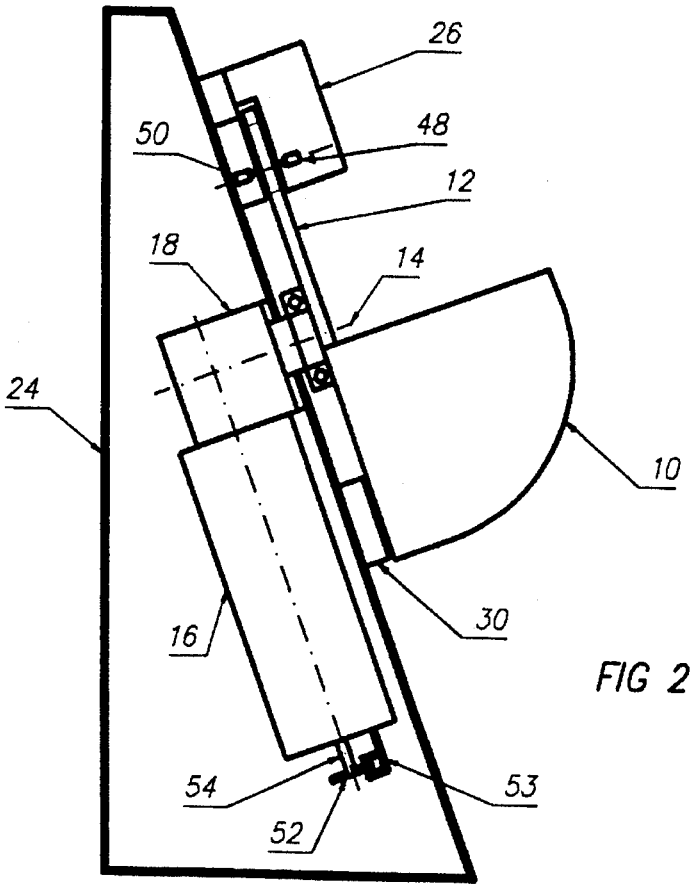
FIG. 2 shows a side view of the coin-identifying and -sorting device of FIG. 1.

Referring now to the drawings, wherein like reference numerals designate identical or corresponding parts throughout the several views, the coin-identifying and -sorting device, as illustrated in FIGS. 1 and 2 is composed of a collecting hopper 10 or a rotatable perforated disc 12 for receiving the coins which are to be identified. The rotatable perforated disc 12 is in an inclined position as seen in FIG. 2 and can be driven about an axis of rotation 14 by a motor 16, via a gear mechanism 18 and a shaft 20, to produce a rotational movement directed in arrow direction 22. That part of the perforated disc 12 which is located beneath the shaft 20 dips into the collecting hopper 10, with the result that individual coins (not shown in FIGS. 1 and 2) are transported, by means of the perforations of the perforated disc 12, upwards and through a light-barrier arrangement 26 which is fastened in a stationary manner on the framework 24 of the coin-identifying and -sorting device. It is ensured, in a manner known per se, that two coins do not simultaneously occupy a perforation of the perforated disc.

In order to prevent the coins from falling out of the perforations 28 of the perforated disc 12, there is located, on the rear side of the perforated disc 12, a ring 30 which is in the form of part of a circle, is arranged behind the perforated disc 12 and has a cutout merely in the region of the light barrier 26 and of which the end edge is identified by the reference numeral 31 in FIG. 1. Located in the end region of the ring 30 downstream of the light barrier 26 is an electromagnetically actuated ejecting device 32 which serves to eject non-satisfactorily identifiable coins out of the perforated disc 12, with the result that the coins fall back into the collecting hopper 10. The ejecting device 32 may also, however, be of different design and ensures that the coins are ejected, for example, by means of an air blast.

As a result of the inclined position of the perforated disc 12, non-ejected coins are automatically passed on to an obliquely downwardly directed rail 34 of the sorting device and roll downwards along this rail. The reference numeral 36 indicates a further electromagnetic ejecting device which sends satisfactorily detected unacceptable coins into an unacceptable-coin compartment 38, to be precise in that the ejecting device 36 thrusts the corresponding unacceptable coins downwards from the rail 34. The ejecting device may also be of a different design. The ejecting device 36 is actuated at the correct time by synchronization with the perforated disc, or is activated for fine tuning by a sensor upon coming into contact with an unacceptable coin. The ring 30 starts again directly beneath the obliquely downwardly directed rail 34.

The sorting device has a series of deflectors 40 which are arranged at different distances d1 to d7 from the rail 34, and deliver the coins into the respective compartments 42 in accordance with their diameters. The reference numeral 45 indicates a control keyboard which is designed in dependence on the actual application purpose of the coin-identifying apparatus and is connected to an evaluation computer 44 (shown only schematically) to which there are connected (control lines not shown) the light-barrier arrangement 26 and the ejecting devices 32 and 36 and, if appropriate, other coin-identifying devices or further computers, for example when using in banks, while the reference numeral 46 represents a display which, likewise connected to the evaluation computer 44, displays the overall value of the counted genuine coins.

Sorting may also be carried out in accordance with other principles. For example, the oblique rail may be equipped, instead of with fixed deflectors, with autonomously operating deflectors. Use may also be made of a positively driven sorter, e.g. a belt or chain sorter having fixed, autonomously operating or activated deflectors.

As can be seen in FIG. 2, the light barrier 26 comprises an optical transmitter 48 and optical receiver 50, which are both connected to the evaluation computer 44.

An incremental transducer 52 can also be seen in FIG. 2, of which the disc is fitted at the end of the shaft 54 of the motor 16. As is conventional in the case of such incremental transducers, the detecting part 53 generates, as a result of the rotation of the disc, a finely resolved pulse sequence which is likewise passed onto the computer 44. The process for identifying the coins is explained in more detail hereinbelow with reference to the further figures.

Figure 3:
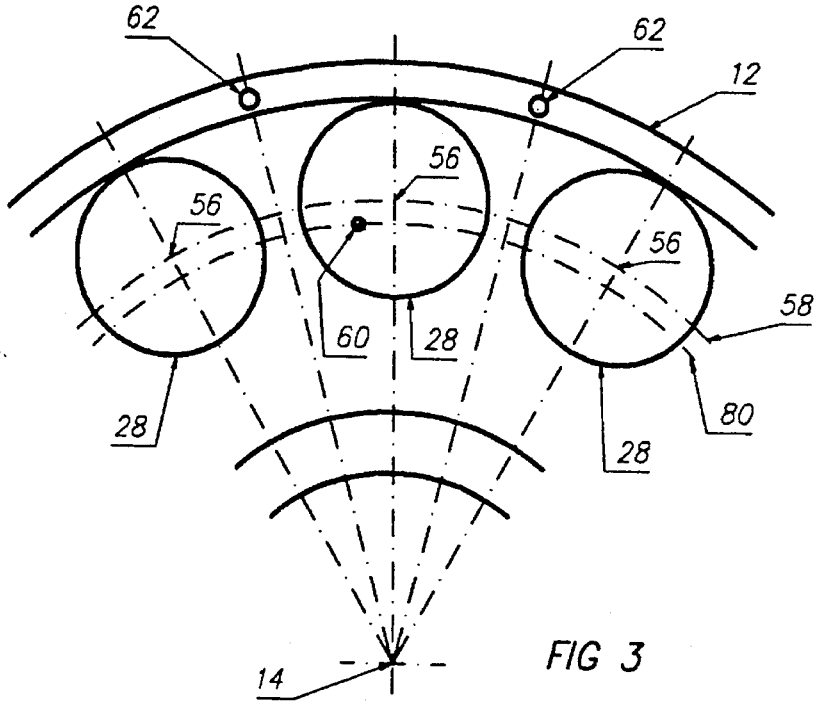
FIG. 3 shows a schematic representation of part of the perforated disc of the configuration according to FIGS. 1 and 2.

FIG. 3 first of all shows a detail of the perforated disc 12 of FIGS. 1 and 2, having three circular, successive perforations 28, of which the central points 56, upon rotation of the perforated disc 12 about the axis of rotation 14, describe a circular path 58, which is represented in chain-dotted lines in FIG. 3. 60 shows a cross-section through the light beam of the light barrier 26 where the light beam passes through the plane of the perforated disc 12. It can be seen that the light beam 60 is located radially within the path 58, in order that the light beam also detects the smallest and largest expected genuine coins. The light beam 60 could also, however, be located radially outside the path 58 as long as it is ensured that it can also detect the smallest coins. The light beam 60 describes a circular path 80 on the surface of the perforated disc 12.

FIG. 3, moreover, shows two markings 62 which, in the case of one variant, interact with a corresponding sensor (not shown) which, upon sensing the markings, generates signals which can serve to provide a measuring-time window or constitute a time-measuring window. In the case of a preferred embodiment, the markings 62 are in the form of perforations which are filled with a transparent or dark (light-reflecting) plastic and are sensed by a sensor in the form of a light barrier (not shown). By filling the perforations 62 with plastic, blockage of the perforations with dirt is effectively avoided. If a measuring-time window is produced, then this can be utilized such that a measurement is possible only within the measuring-time window, between two successive perforations 62. The "perforations" 62 may also be marked in a purely electronic manner by specific pulses from the pulse sequence of the incremental transducer 52 and serve the same purpose, i.e. actual perforations 62 do not have to be present.

FIGS. 4A to 4D show the measuring principle upon rotation of the perforated disc 12, with a one-mark piece 64 in the perforation 28.

Figure 4A:
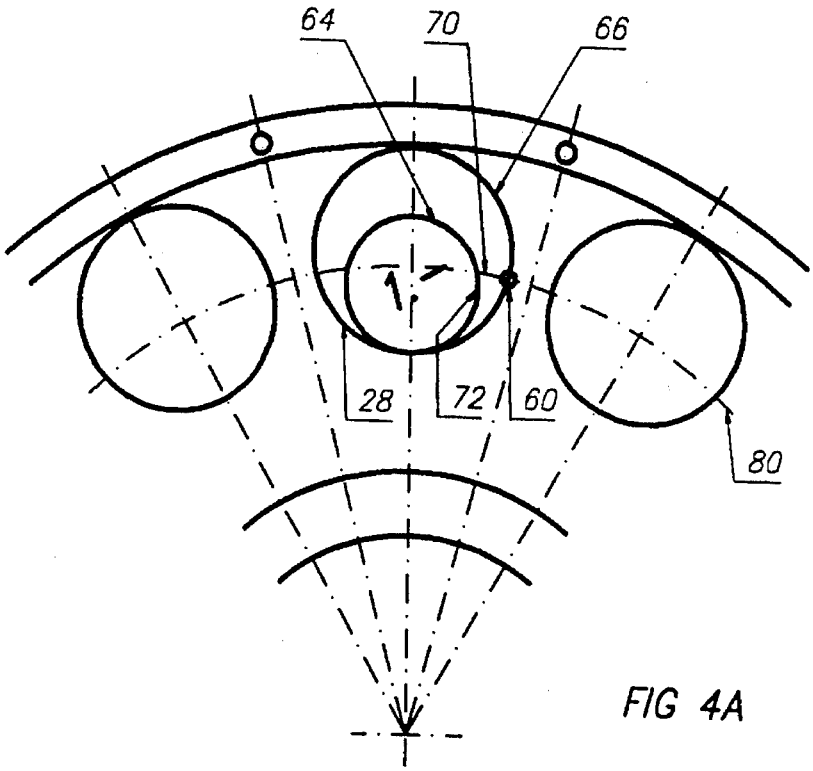
FIGS. 4A, 4B, 4C and 4D show various stages during the determination of the identity of a one-mark piece.
Figure 5:
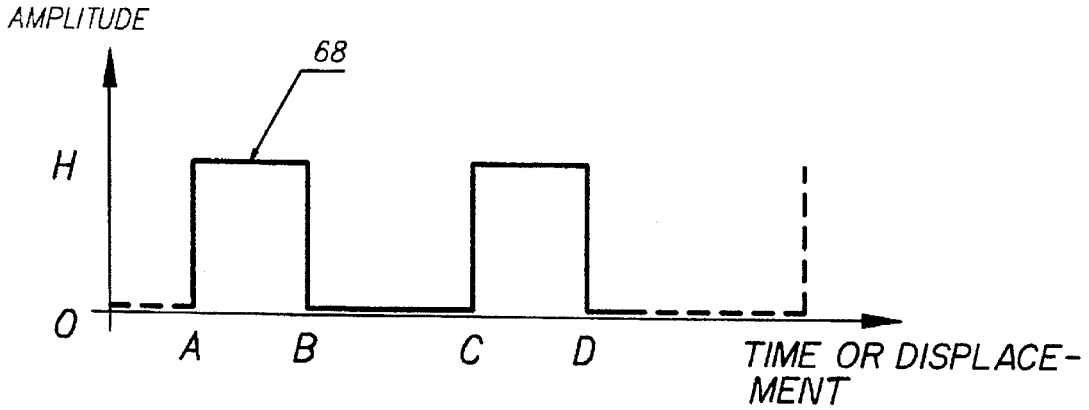
FIG. 5 shows a graphic representation of the light-barrier signal during the measurement according to FIGS. 4A to 4D.

In the stage of FIG. 4A, the perforation border 66 crosses the light beam 60, with the result that the light beam which has, up until now, been interrupted by the material of the perforated disc 12 is released and this results in the rising edge A of the light-barrier output signal 68 of FIG. 5. It goes without saying that this is a manipulated edge which is generated, for example, by differentiating the actual output signal in order to achieve a steep switching edge.

The light beam 60 remains uninterrupted in the first clearance 70 between the perforation border 66 and the front edge 72 of the coin 64, with the result that the corresponding output signal of the light barrier has its maximum amplitude H in FIG. 5.

Figure 4B:
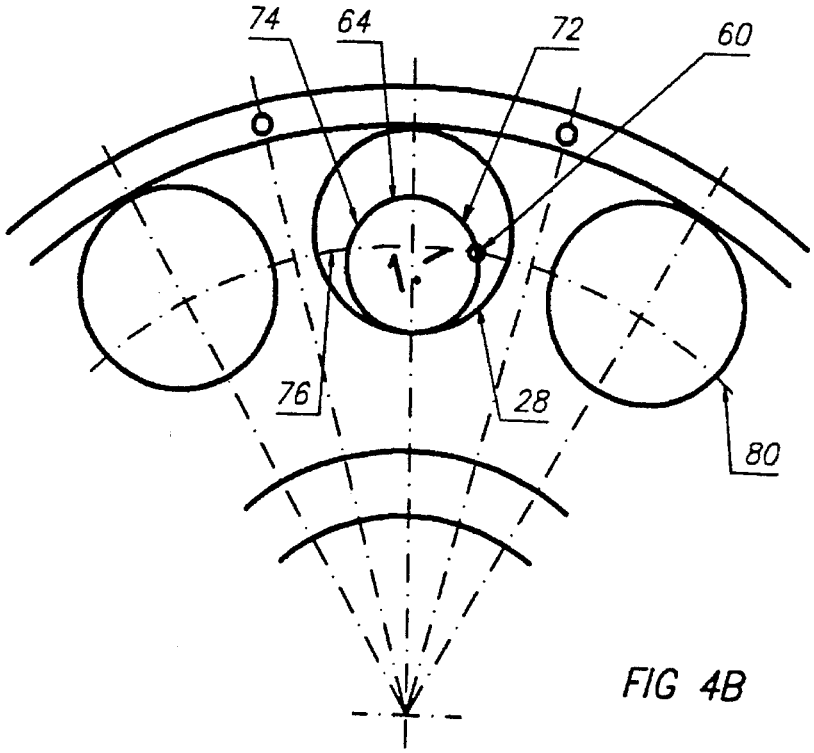

In the stage of FIG. 4B, the front edge 72 of the coin 64 reaches and crosses the light beam 60 and this results in the falling edge B of the light-barrier signal. The output signal of the light barrier goes back to the value 0.

Figure 4C:
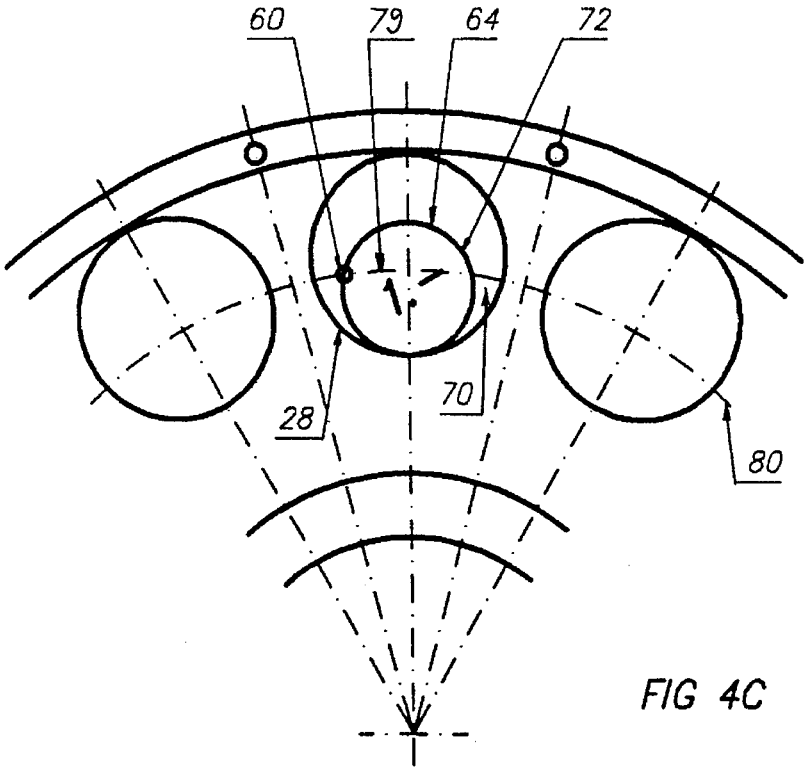
Figure 4D:
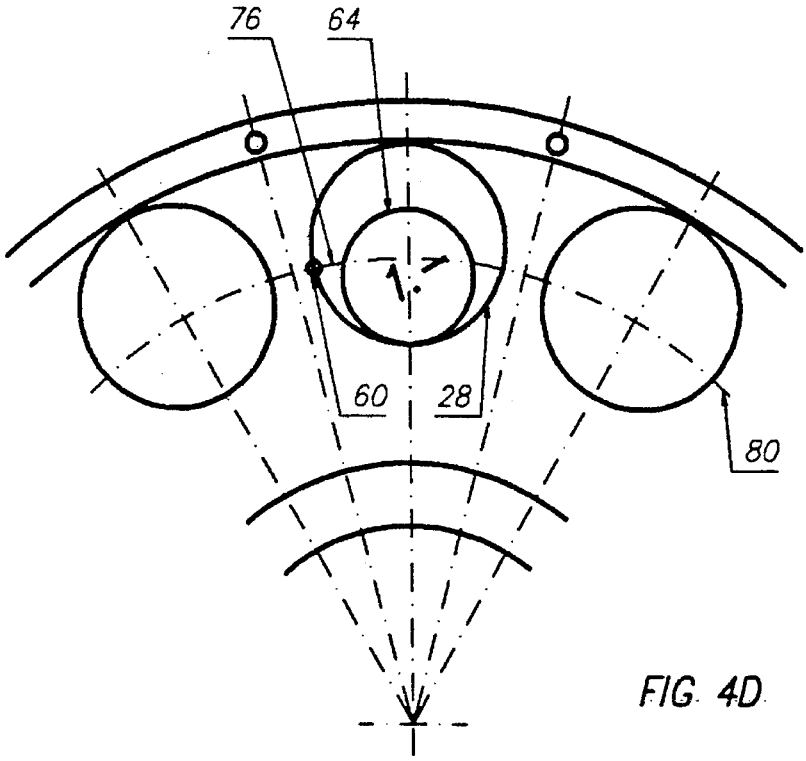

In the further stage up to FIG. 4C, the light beam 60 remains interrupted, to be precise by the coin 64 in the region between its front edge 72 and its rear edge 74. When the rear edge 74 crosses the light beam 60 and releases the latter increasingly, this results in the rising edge C in FIG. 5, and the output signal of the light barrier then reaches its maximum height H again. Upon further rotation of the perforated disc 12, the signal level remains at the value H when the light beam is located in the further clearance 76. When the perforation border 66 crosses the light beam, in the stage of FIG. 4D, the light beam is interrupted once again and the signal drops to the value 0 again. The measurement in the perforation 28 with the coin 64 is now complete and there follows a further measurement for the subsequent perforation 28, the corresponding edge of the light-barrier signal in FIG. 5, which edge rises again, being shown merely by a dotted line.

The distance between the two vertical edges A and B in FIG. 5 thus corresponds to the dimension of the clearance 70, measured along the circular path 80. The distance between the edges B and C in FIG. 5 corresponds to the dimension of the coin 64 along the chord 79 described by the circular path 80. The distance between the edges C and D of FIG. 5 corresponds, in turn, to the dimension of the clearance 76, here, too, measured along the circular path 80.

Assuming that the coin 64 is located in the perforation precisely in the position represented, the dimension of the clearance 70 and the dimension of the clearance 76 as well as the length of the chord 79 correspond satisfactorily to the respective characteristic lengths for a one-mark coin, with the result that the coin can be satisfactorily identified by the determination of the distances between the edges A and B, B and C and/or C and D.

Should it not be possible to identify the respective coin satisfactorily as a result of the measurements carried out and evaluated, then the coin is thrown back into the collecting container 10 by means of the ejecting device 32 and retested. This method permits narrower tolerances since, if there is any doubt, "no" can be said. Since the tolerances can be made narrower, the reliability of the identification is better.

As a basic measurement, only the arcuate chord 79, which is covered by the coin during the rotation of the perforated disc, can be measured. The perforation geometry is thus not included.

The determination of these lengths can be carried out either as a time measurement, assuming that the speed of rotation of the perforated disc is constant during the measuring period, or can be carried out as a measurement of displacement. For the displacement, it is preferably the angle which the perforated disc covers which is measured. Although this angle can be measured on the perforated disc itself, this is relatively inaccurate and the angle is preferably measured by way of the incremental transducer 52 on the motor shaft, which rotates, for example, at 2700 revolutions per minute. The precondition of this type of angle determination is that there are rigid transmission ratios between the incremental disc on the motor shaft and the perforated disc, this often being the case if a gear mechanism is located therebetween, the intention being for the gear mechanism to be designed such that it is preferably free of play. Technically, a number of solutions are conceivable.

In the case of a time measurement, use is made, for said time measurement, of the clock signal present in the evaluation computer 44.

AS a result of the signals of the incremental transducer, the computer 44, however, also picks up whether the speed of rotation of the perforated disc 12 is constant during the measurement. Should this not be the case, for example during start-up of the perforated disc 12, then, via the ejecting device 32, the coins can be delivered back into the collecting container 10 again until the speed of rotation of the perforated disc 12 is constant. In general, the start-up and stopping of the perforated disc are not ideal for carrying out the measurements. Since measurements in these phases are not taken into consideration, and the coins are delivered back into the collecting container in these phases, an additional stopping motor is superfluous.

In the event of fluctuations in operation, which can occur, for example, due to the resistance of the mixture of coins, the coins thus measured are likewise delivered back into the container 10 since the soundness of the corresponding measurements is not guaranteed.

In the case of a measurement of displacement, the signals from the incremental transducer 52 are used by the evaluation computer 44 in order to determine the displacement lengths between the edges A and B and/or B and C and/or C and D.

As a result of this measurement of displacement, changing speeds of rotation of the perforated disc 12 do not in themselves result directly in falsification of the measured value. However, fluctuations in the speed of rotation of the perforated disc 12 may result in undesired movement of the coins back and forth, with the result that, for example, a ten-pfennig piece could adopt the three different positions in accordance with FIG. 6 during the measurement. Consequently, falsification of all three measurements, i.e. the dimensions of the two clearances and of the chord length of the coin, is to be expected, with the result that in the event of fluctuations in the speed of rotation of the perforated disc 12, in the case of a measurement of displacement too, the coins are to be delivered back into the container 10, for the sake of caution, by the ejecting device 32.

Figure 6:
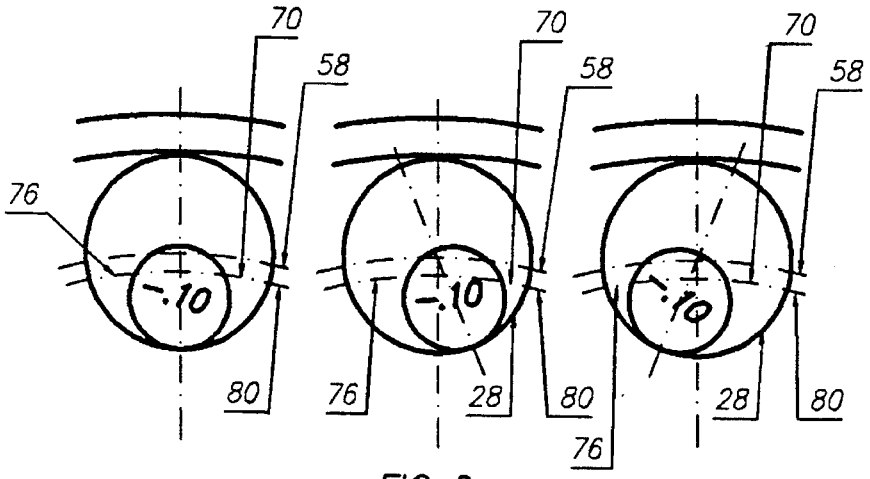
FIG. 6 shows a schematic representation of three possible positions of a ten-pfennig piece during a measurement.

Movement of the coins within the perforations of the perforated disc 12 in accordance with FIG. 6 is not only to be expected in the event of a fluctuation in the speed of rotation of the perforated disc 12, but may also have other reasons. FIG. 6 also shows how different values of the dimension of the two clearances 70 and 76 can inform that the coin is not in a stable position within the perforation. In this case, the coin is ejected back into the collecting container 10.

Figure 7:
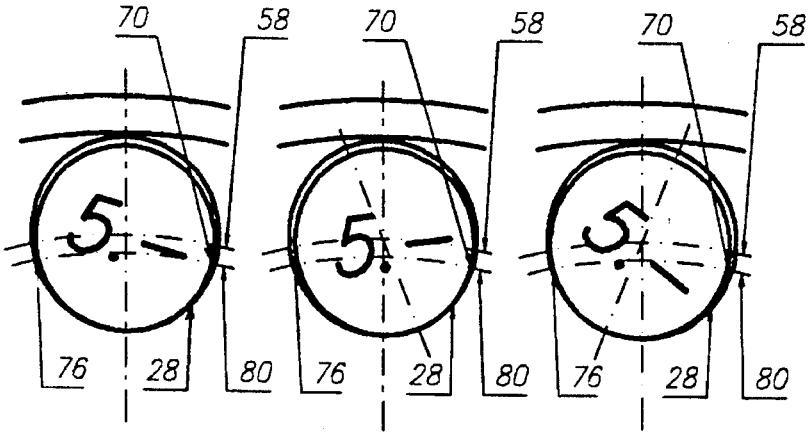
FIG. 7 shows a schematic representation of three different positions of a five-mark piece during a measurement.

FIG. 7 shows, in principle, the same state of affairs, but with a five-mark piece, which, in this example, has the largest diameter of the coins to be sorted. Here too, the two clearances 70, 76 differ from one another, the clearances, however, due to the size of the coin, being much smaller than as is the case in the example of FIG. 6. However, such changes in position of the coin can be detected as a result of the signals of the light barrier 26.

Figure 8:
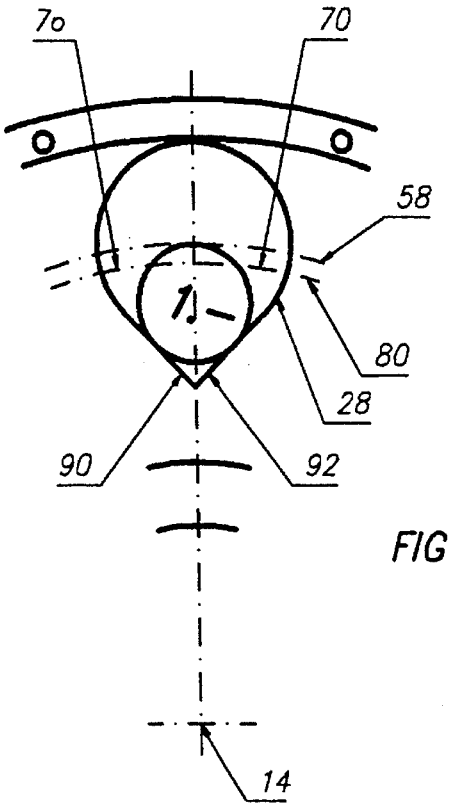
FIG. 8 shows a modified perforation shape for stabilizing the position of the measured coin.

FIG. 8 shows a modified shape of the perforation 28, which shape serves to stabilize the position of the coins. This modified shape is circular in the upper region, but in the lower region has two inwardly converging straight sides 90 and 92 which, to the greatest extent, avoid movement of the coins back and forth.

Figure 9:
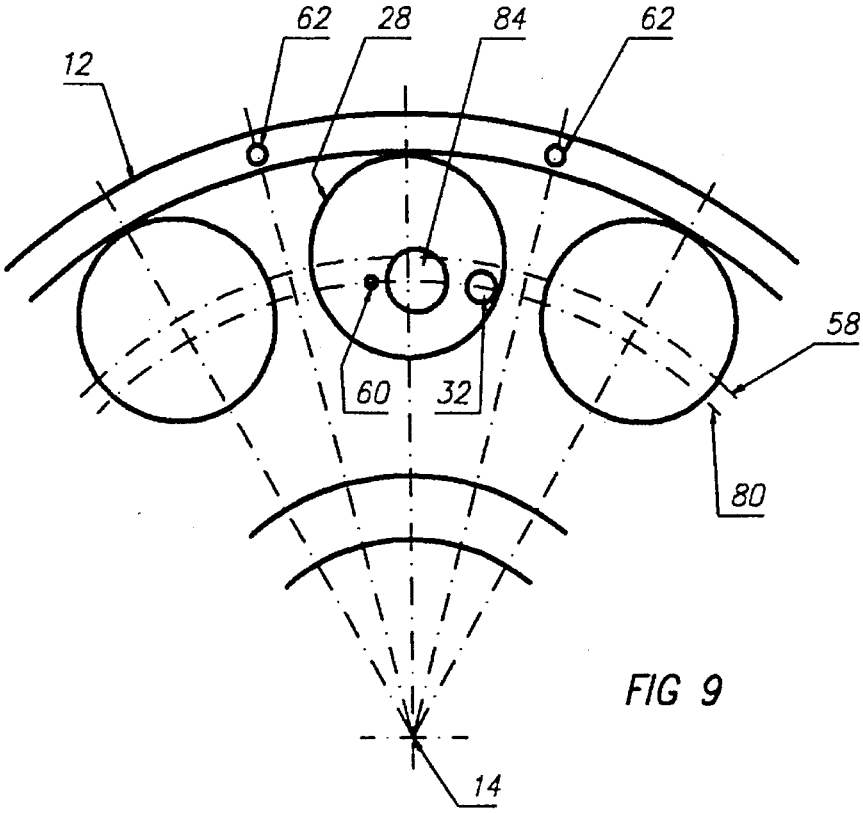
FIG. 9 shows a modified embodiment of the detection device.

FIG. 9 shows a modified apparatus, in the case of which, in addition to the measurement of the chord length of the coin and/or of the length of the corresponding clearances by means of the light-barrier beam 60, there is provided a probe 84 in order to determine a different property of the coins, for example the alloy. The result of this measurement may also be passed onto the evaluation computer 44 and be taken into consideration for the identification of the coin. The probe 84 may be, for example, an inductive probe or sensing device, such as is known, for example, from GB-A-2 135 492, and/or a capacitive probe.

FIG. 9 also shows the possibility of positioning the ejecting device 32 such that it can directly eject the respective coin out of the perforation. This is favorable insofar as deceleration of the control signal for the ejecting device 32 is no longer necessary here.

The locations marked by the markings 62 and/or the corresponding electronic signals from the incremental transducer can be used, instead of the edges A and D of the light-barrier signal of FIG. 5, for the measurement of the dimensions of the clearances 70 and 76 of the coin 64. In the same way, they can open and close a time-measuring window, with the result that the evaluation computer 44 takes into consideration only those measured values which occur within this time-measuring window. That is to say, the measurement may also, however, be triggered before the perforation border 66 releases the light barrier 26, and thus the clearance between the perforation border and the coin is measured. For geometrical reasons, this measurement defines the size of the round coin 64 provided that the latter is located correctly in the perforation 28. As a result of dynamics, a characteristic measured value is obtained for each coin diameter upon uniform movement of the perforated disc. This measured value can be learned in the machine.

By decelerating these signals, for example that location of the perforation border 66 of the perforated disc 12 at which the border intersects the curved path 80 can be simulated.

It should be pointed out that the light barrier does not have to be a transmission light barrier, as is shown here, but can also be a reflection light barrier, in the case of which the optical receiver is arranged on the same side of the perforated disc as is the optical transmitter.

Although the embodiment which has just been described comprises a sorting machine, it is readily possible to dispense with the sorting principle and operate the device merely as a money-counting machine or coin-testing means.

In practice, it is very important to use a perforated-disc arrangement having a positioning device for the coins in order that it can be ensured that all the coins, in the region of the light beam or of another sensing device, e.g. an image-reading apparatus, always assume a desired position and, due to different positions or changing positions, do not lead to an unreliable measuring result.

Figure 10:
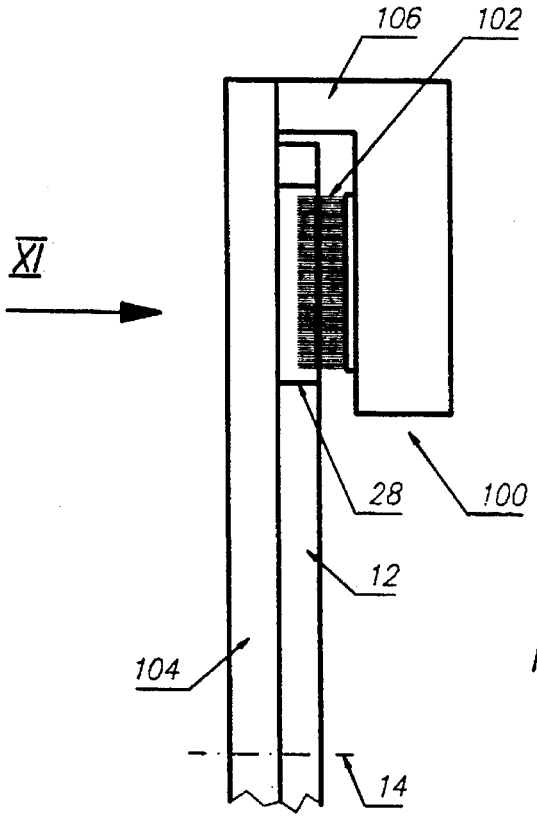
FIG. 10 shows an apparatus according to the invention, having a positioning device in the form of a stationary brush.

FIG. 10 shows a first example for such a positioning device 100, here in the form of a mechanical braking device formed by a brush 102, which is borne by a fixed carrying arrangement 104 arranged on the other side of the perforated disc, it being possible for the carrying arrangement 104 to be, for example, a modified embodiment of the ring 30 or of the frame 24. The brush 102 is actually borne by a securing means 106 which is screw-connected to the carrying arrangement 104.

The length of the bristles can be longer or shorter than shown, the only essential factor is that the bristles have to be in contact with all possible coins which may be present, in order to have a braking effect on the coins.

Figure 11:
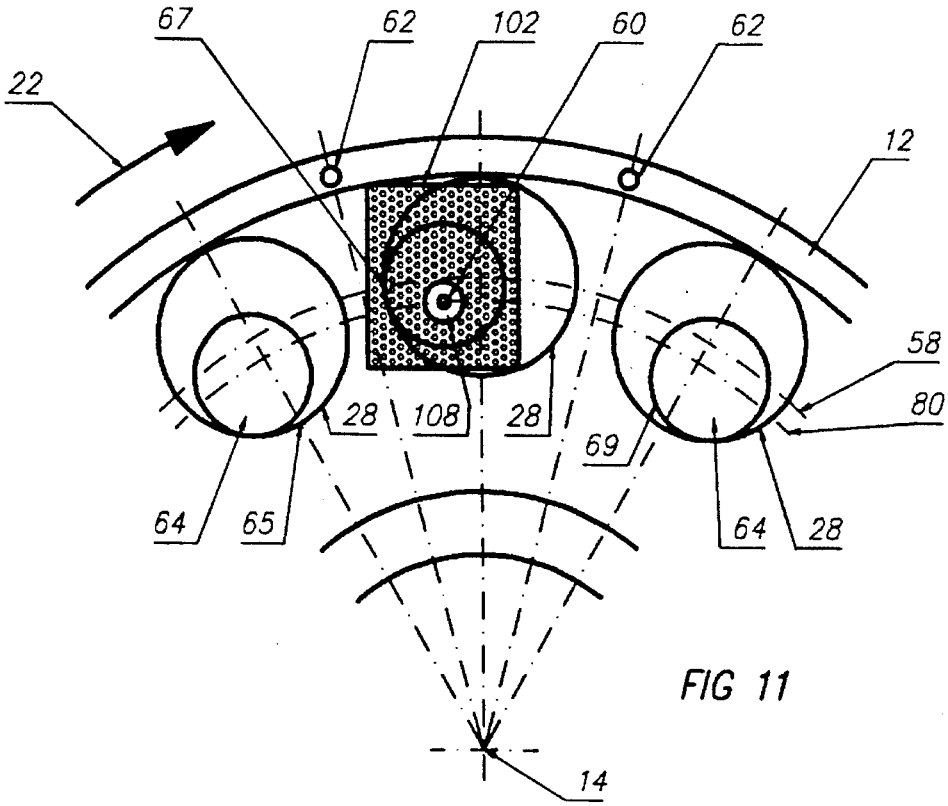
FIG. 11 shows a schematic representation of the perforated disc of FIG. 10 with brush, as seen in arrow direction XI of FIG. 10.

This braking action is illustrated schematically in FIG. 11, it also being shown in FIG. 11 that the longitudinal side of the rectangular brush, as seen in the direction of arrow XI of FIG. 10, in this example is selected to be slightly smaller than the diameter of the perforations 28 of the perforated disc 12. It can also be seen in FIG. 11 that the brush 102 has a circular cutout 108, in order that the light beam 60 of the light barrier can pass through the brush. In this example, the optical transmitter (not shown) is arranged, for example, in the securing means 106, while the optical receiver (likewise not shown) is mounted on the carrying arrangement 104.

It can be seen in FIG. 11 that a coin 64 advanced by the perforated disc 12 in arrow direction 22 is located, before reaching the brush 102, in the lower region of the perforation 28, but not at the radially innermost location 65 thereof. The precise position of the incoming coin 64 is unimportant in this embodiment. During the rotation of the perforated disc, the bristles of the brush 102 come into contact with the coin 64 and have a braking and positioning effect on said coin, with the result that the coin 64, in the region in which it is still under the influence of the brush 102, comes to bear on the perforation border which is on the left-hand side in FIG. 11, to be precise such that the coin, in the region 67 of the left-hand perforation border, comes into contact with the latter at the location where the circular path 58 of the perforation centers intersects it. After the respective perforation 28 has left the region of action of the brush and has reached, for example, the position on the right-hand side of FIG. 11, the coin 64 rolls from the position established by the brush into the position 69 shown there.

Figure 12:
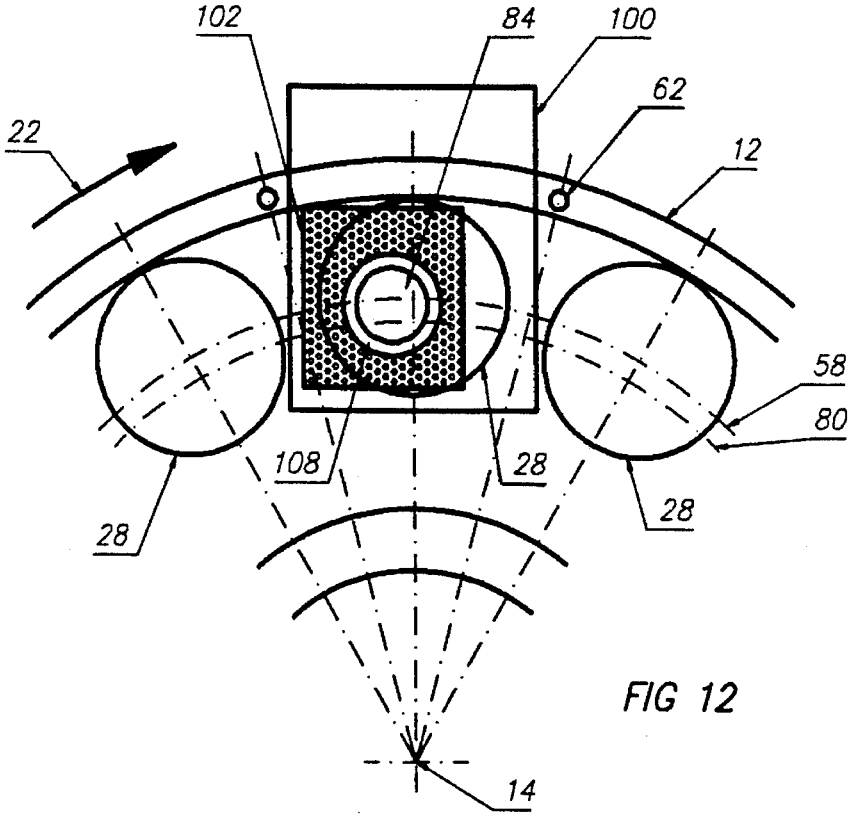
FIG. 12 shows a schematic representation similar to FIG. 11, but of a modified embodiment.

FIG. 12 shows a modified embodiment, in the case of which, instead of a light barrier, use is made of an inductive and/or capacitive sensing device 84. In this case, the circular cutout 108 of the brush is made to be larger in diameter in order to provide sufficient space for the inductive and/or capacitive probe 84. In terms of the positioning of the coins in the perforations 28, the mode of operation of this embodiment is, however, identical with the configuration of FIGS. 10 and 11, for which reason it is not described in any more detail here.

Figure 13:
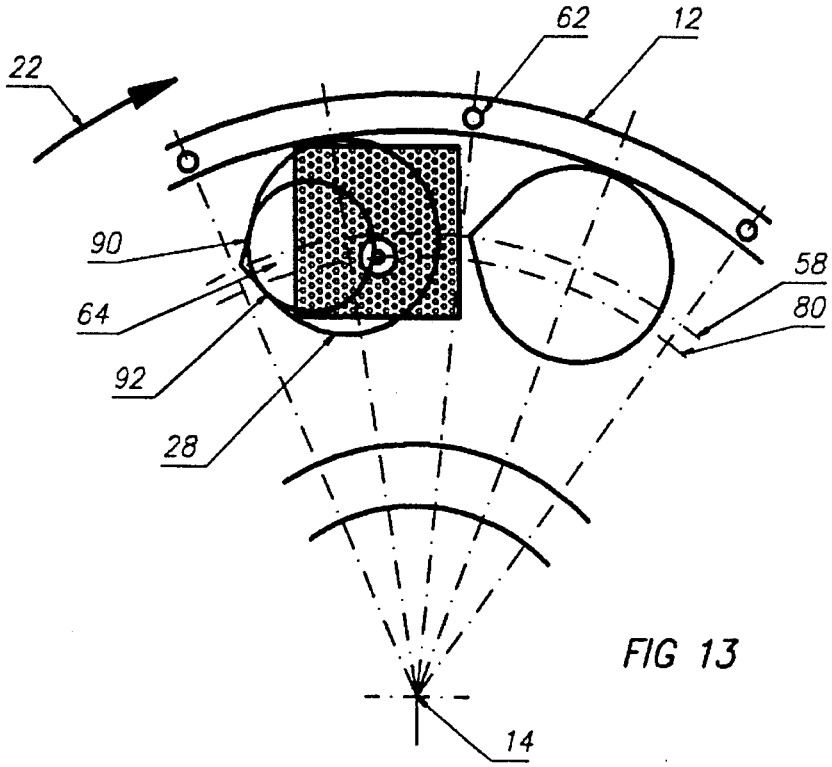
FIG. 13 shows a schematic representation similar to FIG. 11, but with a special perforation shape.

FIG. 13 shows an arrangement similar to the configuration according to FIGS. 10 and 11, in the case of which, however, the perforations 28 of the perforated disc 12 are of a different shaping in order that the coins are positively driven after positioning by the brush 102 and adopt an absolutely stable position. For this purpose, the perforations 28 of the embodiment according to FIG. 13 have a shaping similar to that of FIG. 8, the rectilinear region 90 and 92 of the perforation shape here, however, not converging radially inwards, but in the circumferential direction of the perforated disc, in the region of the path 58 of the perforation centers, to be precise in the rear region of the perforations 28 as seen in the direction of rotation 22 of the perforated disc.

Figure 14:
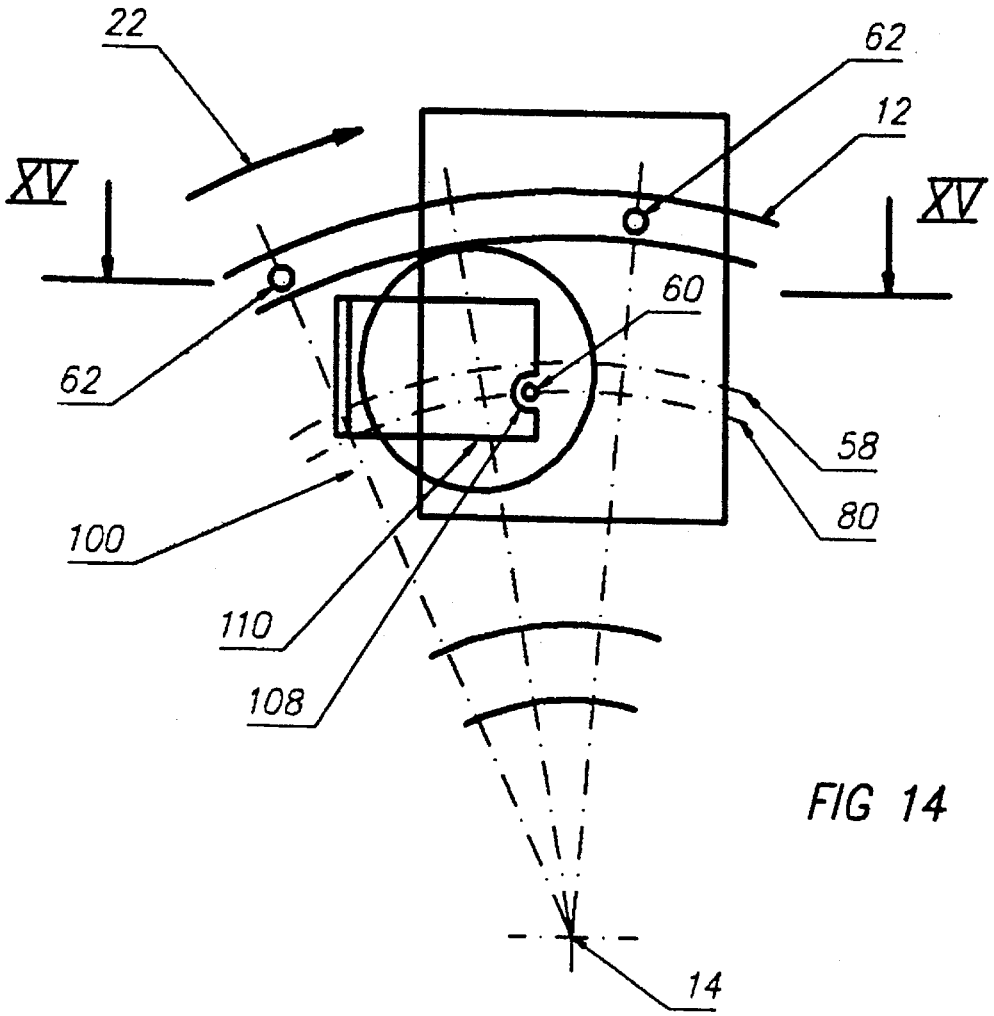
FIG. 14 shows a representation similar to FIG. 11, but with a positioning device in the form of a leaf part.
Figure 15:
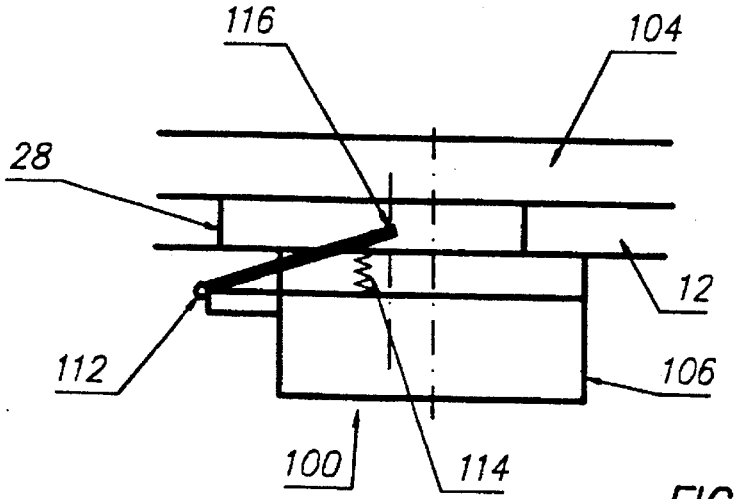
FIG. 15 shows a schematic representation of the device of FIG. 14, corresponding to the arrows XV—XV.

The positioning device, which has a mechanical braking effect, may also, however, be of a different design than is shown in FIGS. 10 to 13. A further possibility for producing a mechanical brake is shown in FIGS. 14 and 15. Here, braking is effected by a leaf part 110 which is designed here as a movable flap and is articulated by securing means 106 such that it can pivot about a hinge 112. A schematically represented compression spring 114 presses the movable flap 110 in the direction of the perforated disc, with the result that the free end 116 of the flap 110 can come into contact with the coins, to be identified, when said coins, in a respective perforation of the perforated disc, are transported past the braking device 100. In this embodiment too, the brake has a cutout 108 in order that the light beam of the light barrier is not interrupted by the flap 110. The flap 110 or its side directed towards the perforated disc may consist of plastic, with the result that sufficient friction can be achieved without a pronounced degree of wear.

The braking device may also, however, be of a different design. For example, it may be formed by an air nozzle (not shown) which, by means of a directed air jet, presses the coins in the direction of the perforations located one behind the other. Electromagnetic braking devices (likewise not shown) could also be considered.

However, the positioning device does not have to be designed as a braking device, it may also be designed as an accelerating device in order, for example, to press the coins in the direction of the leading perforation border. Finally, it would additionally be conceivable also to press the coins, by means of a positioning device, onto the upper or lower perforation border or else also onto any location of the perforations.

Figure 17:
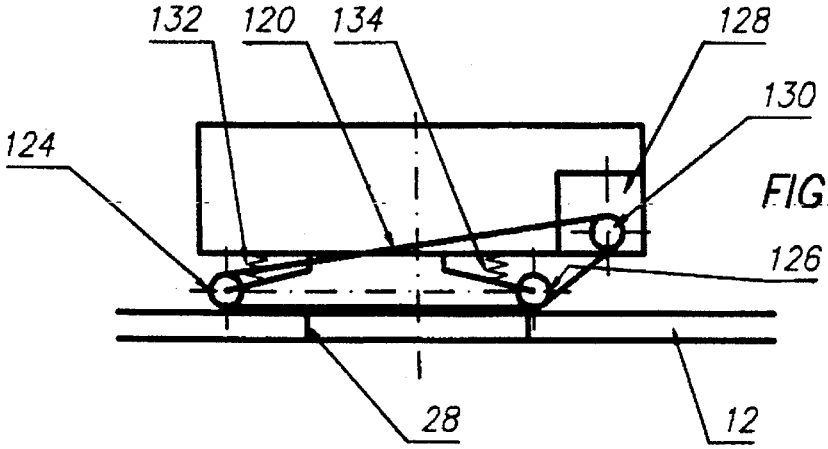
FIG. 17 shows a schematic view of the embodiment of FIG. 16, as seen along section plane XVII—XVII.
Figure 16:
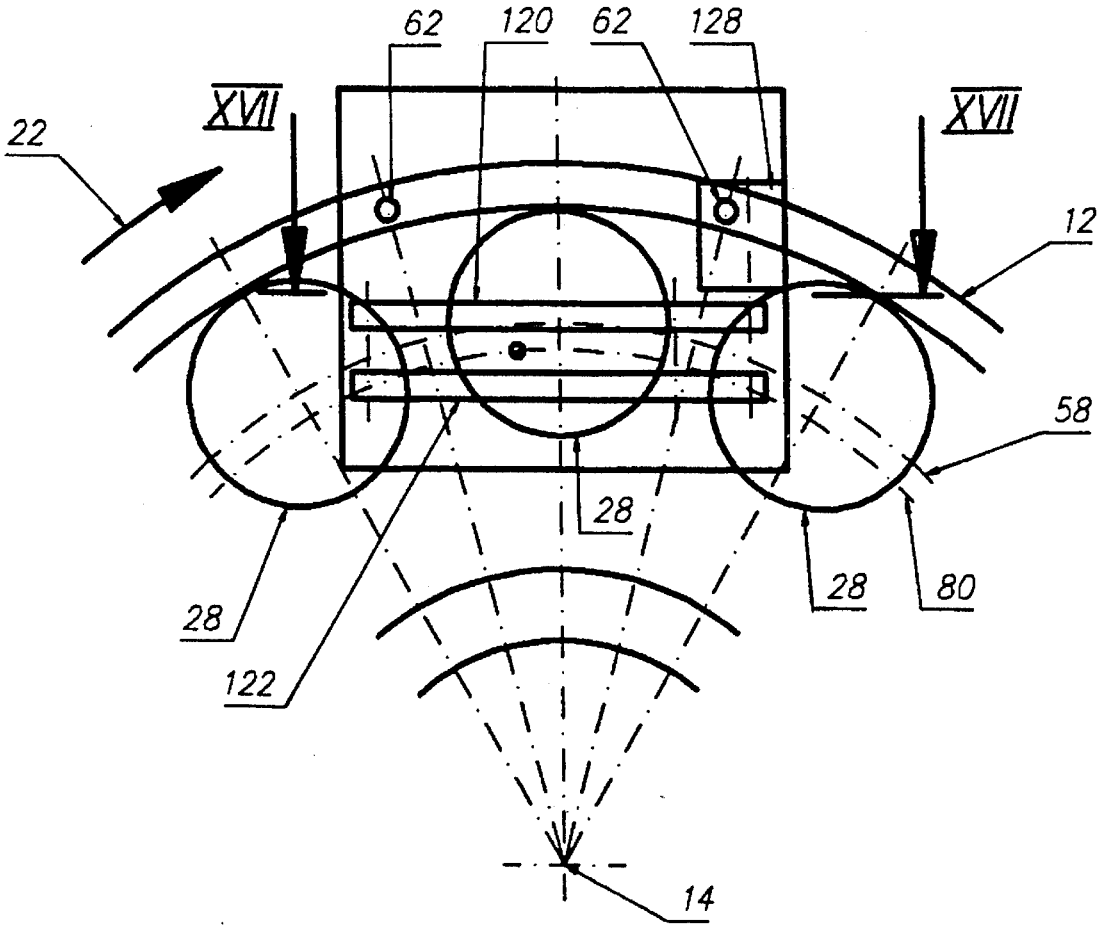
FIG. 16 shows a schematic representation similar to FIG. 14, but of a modified embodiment with a different positioning device.

FIGS. 16 and 17 show a positioning device which is designed such that the coins are pressed onto the leading border of the perforations.

For this purpose, the positioning device 100 in this example has two circulating belts 120, 122 which run around two deflection rollers 124 and 126 and around a roller 130 which is driven by a motor 128. The axes of the deflection rollers 124 and 126 and of the drive roller 130 are located parallel to one another and to the plane of the perforated disc. Two belts do not have to be provided, this embodiment could also be realized with merely one belt. Finally, more than two belts could also be considered.

In this example, the deflection rollers 124 and 126 are borne on resilient suspension means 132 and 134, with the result that the respective rollers 124 and 126 are constantly pressed in the direction of the perforated disc and thus, when a perforation 28 runs past, are partially pressed into the perforation and, in this manner, reliably come into contact with the respective coins. It is thus ensured that the belts 120, 122 have a reliable positioning effect on the coins.

If the speed of circulation of the belts 120, 122 is selected such that the speed is higher than the surface speed of the perforated disc in the region of the belts, then the coins arranged in the individual perforations 28 of the perforated disc are accelerated with respect to the perforated disc and pressed onto the leading perforation border, with the result that they adopt a stable position here for the duration of the measurement. The device shown in FIGS. 16 and 17 could, however, also be used as a braking device. In this case, the speed of circulation of the belts would have to be slower than, or directed in the opposite direction to, the surface speed of the perforated disc in the region of the belts.

Assuming that the positioning device 100 of FIGS. 16 and 17 is designed for positioning the coins on the leading perforation border, its mode of operation is explained in brief with reference to FIGS. 18 to 23.

Figure 18:
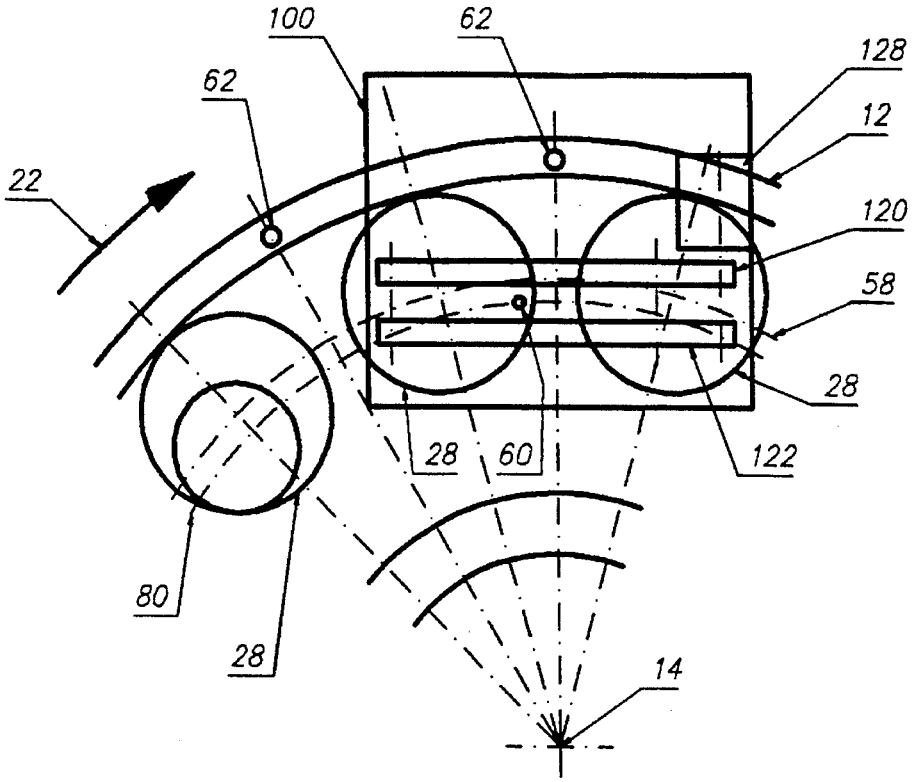
FIGS. 18 to 23 show representations similar to FIG. 16 in order to illustrate the mode of operation of the apparatus of FIG. 16 upon rotation of the perforated disc.
Figure 19:
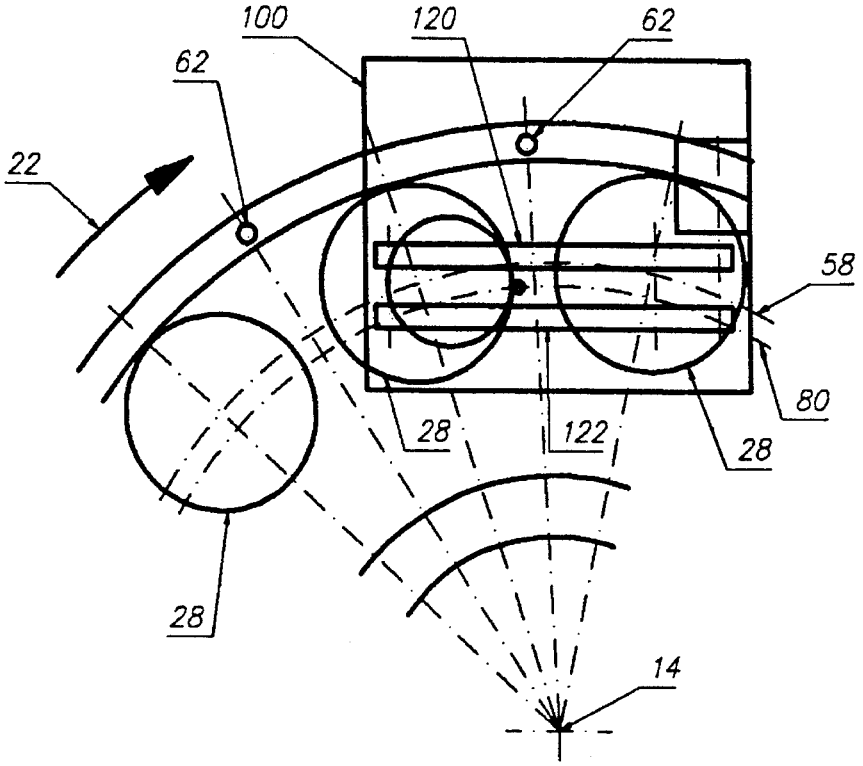

FIG. 18 shows a coin 64 which is advanced by the perforated disc 12, by rotation of the same in arrow direction 22, up to the positioning device. The measurement takes place in this example by the light beam 60 of a light barrier (not shown). If the perforated disc 12 moves from the position represented in FIG. 18 into the position shown in FIG. 19, then the coin 24 passes into the region of action of the belts 120, 122 and is positioned on the front perforation border, as is shown in FIG. 19. In this exemplary embodiment, the measurement of the leading edge of the coin 64 is triggered preferably electronically since, depending on the actual design of the device, there is little to no clearance between the leading edge of the perforation 28 and the coin 64 in the region of the light beam 60.

Figure 20:
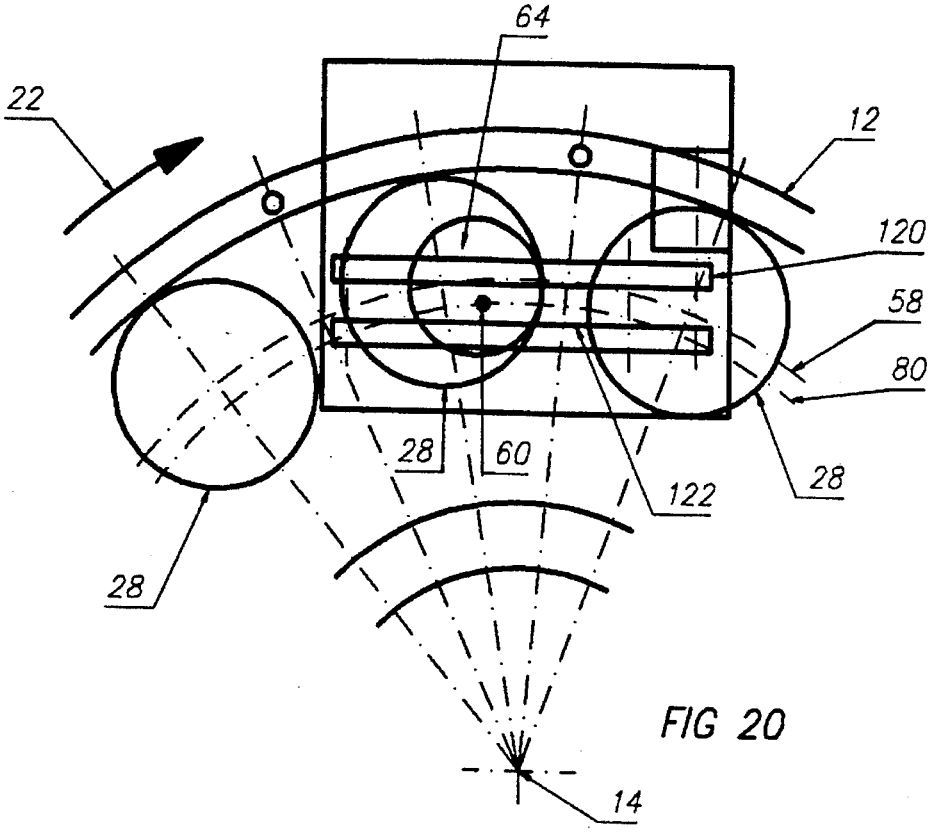

Upon further movement of the disc 12 into the position of FIG. 20, the light beam 60 is interrupted by the coin 64. It is only when the position according to FIG. 21 has been reached that the light beam 60 is released again by the coin, to be precise until the rear border of the perforation 28 has crossed the light beam 60, in accordance with FIG. 22.

Figure 21:
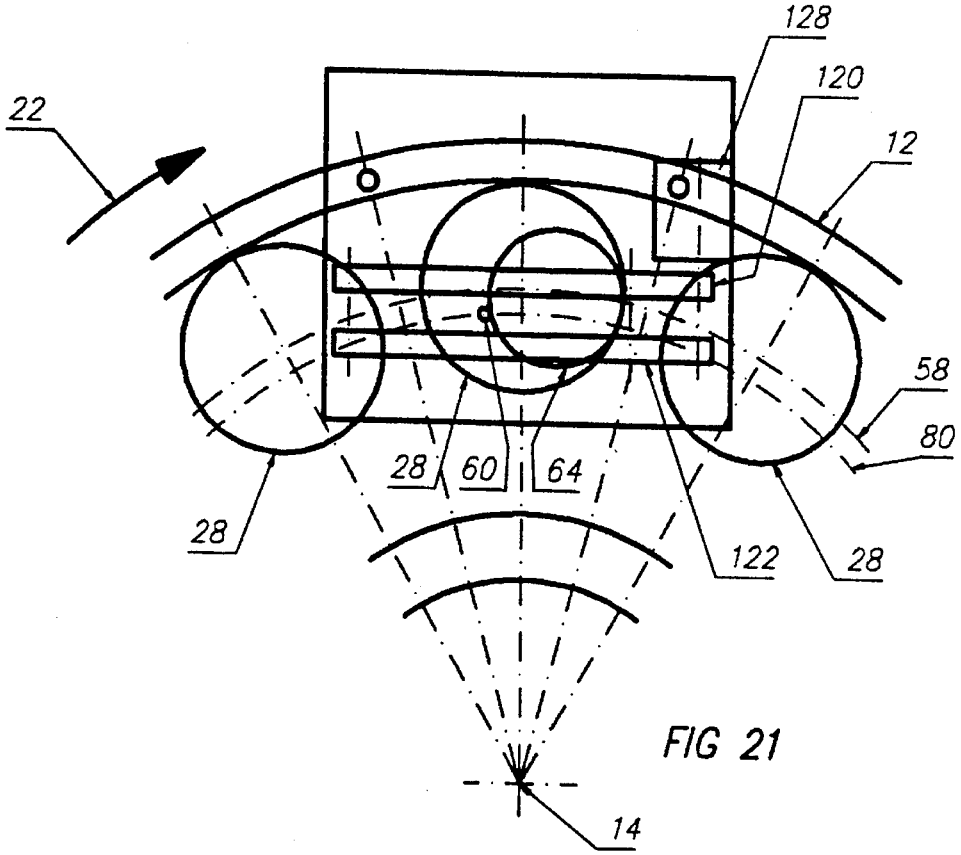
Figure 22:
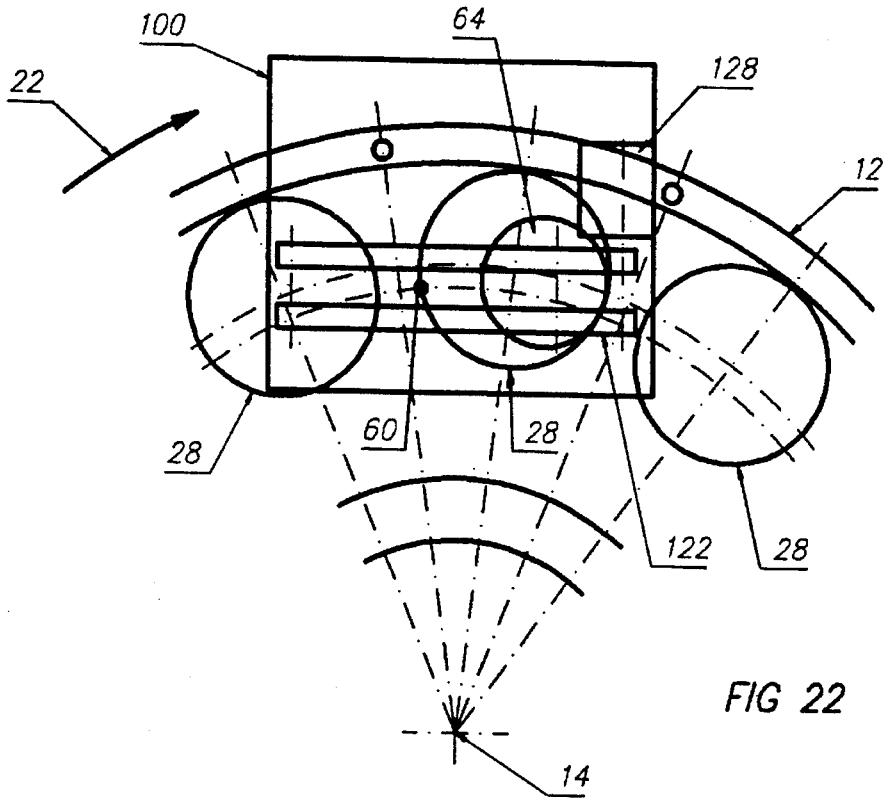

In this example therefore, a measurement is taken either of the chord of the coin on the passage of the perforated disc between the positions of FIG. 19 and FIG. 21 or of the width of the clearance along the circular path 80 during the rotation of the perforated disc between the positions of FIGS. 21 and 22, or the two measurements are carried out.

As a result of the positioning of the coin, not more than two measurements or, if appropriate, only one measurement are/is required in order to achieve a reliable measurement, as a result of which the work to be carried out by the computer is restricted, the programming thereof is simpler and the identification procedure can run more quickly.

Figure 23:
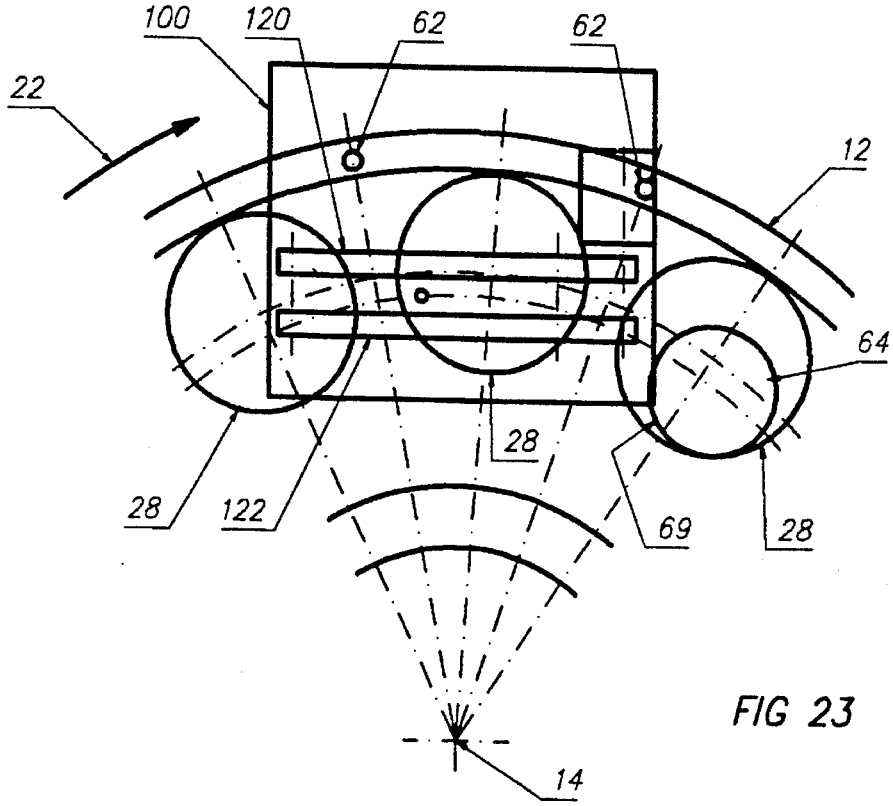

Finally, FIG. 23 shows that the coin 64 adopts another position 69 in the perforation 28 when it has left the region of action of the belts 120, 122.

It goes without saying that the positioning device of FIGS. 16 to 23 can also operate with other sensing devices, for example with an inductive and/or capacitive sensing device, and that a plurality of differently designed sensing devices, for example a light barrier and an inductive and/or capacitive measuring device, can also be used simultaneously.

It should again be pointed out here that the various positioning devices 100 shown in FIGS. 10–23 can be used together with an extremely wide range of sensing devices, i.e. for example also with an image-reading apparatus.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for identifying coins, the process comprising the steps of:

separating coins with a separating device, wherein the separating device comprises a continuously rotatable disc having receiving compartments for individual coins;

moving the coins rotating with the separating device within the receiving compartments by applying accelerating or decelerating forces to the coins so as to move the coins into a specific position within an associated receiving compartment such that in said specific position, the separated coins abut against a leading or trailing border of said receiving compartment; and identifying the separated coins by at least one measurement while the separated coins are located within the receiving compartments and held in said specific position.

2. A process according to claim 1, comprising the further step of checking whether a speed of rotation of the disc is essentially constant during the measurement and has a correct value and, for identifying coins, use is made only of such measurements in which the speed of rotation of the disc is essentially constant and has the correct value.

3. A process according to claim 1, comprising the further step of carrying out the measurement as a measurement of displacement, which utilizes a displacement-measuring device which is coupled directly or indirectly to the disc.

4. A process according to claim 1, comprising the further step of detecting an unacceptable coin and/or an unacceptable measuring result, and guiding the appropriate coin back into a coin hopper which feeds the disc upon said detection.

5. A process according to claim 1, comprising the further step of accepting a reliability of the detection of unacceptable coins and separating out unacceptable coins only upon detection of a plurality of unacceptable coins one after the other.

6. A process according to claim 1, comprising the further step of feeding the coins to a coin-sorting section after identification.

7. A process according to claim 1, comprising the further step of determining an overall value of the identified coins as a result of the measurements carried out.

8. A process according to claim 1, comprising the further step of using an inductive and/or capacitive sensing device to identify the coins.

9. A process according to claim 1, comprising the further step of using a non-circular perforation shape to stabilize the position of the coins in the receiving compartments of the disc.

10. A process according to claim 9, wherein said non-circular perforation shape comprises two straight sides which converge in a direction of rotation of the disc or in a direction opposite to the direction of rotation.

11. A process according to claim 1, comprising the further step of carrying out said measurement by means of a light barrier which exhibits an optical transmitter and optical receiver and of which a light beam is directed onto a plane of the disc, in a region of the receiving compartments, such that, from signals of the optical receiver, at least one of a size or identity of the individual coins contained in the receiving compartments of the disc can be determined.

12. A process according to clam 11, comprising the further step of measuring a dimension of a chord of the separated coins positioned in the receiving compartments by means of the light barrier.

13. A process according to claim 11, comprising the further step of determining a dimension of a clearance between a respective boarder of a receiving compartment and at least one of a front or rear border of a separated coin positioned in said receiving compartment by means of the light barrier.

14. A process according to claim 11, comprising the further step of utilizing a period of time during which the light beam is reflected or interrupted by the coin in order to identify the respective coins.

15. A process according to claim 11, comprising the further step of defining measuring-time windows, during which the receiving compartments of the disc move through the light beam, such that only measuring signals which are generated during the measuring-time window are evaluated.

16. A process according to claim 11, comprising the further step of establishing a beginning and/or an end of the measurement by a signal generated by other means than the light barrier and marking the border of a receiving compartment or a reference point adjacent to this border.

17. An apparatus for identifying coins, the apparatus comprising:

a separating device including a continuously rotatable disc provided with receiving compartments for individual coins;

a sensing device for measuring a property of the coins, the sensing device being arranged in a region of a path defined by the receiving compartments upon a rotation of the disc;

a computing device for determining a size and/or identity of respective coins from signals from the sensing device as a result of a presence of a coin in an associated receiving compartment; and a positioning device comprising means for moving the coins rotating with the separating device within the receiving compartments by applying accelerating or decelerating forces to the coins so as to move the coins, at least in a region of the sensing device, into abutment against a leading or trailing border of the associated receiving compartment.

18. An apparatus according to claim 17, further comprising a displacement-measuring device which, corresponding to the rotation of the disc, generates displacement-measuring pulses, such that the displacement-measuring device is connected to the computing device.

19. An apparatus according to claim 17, further comprising a device which is connected to the computing device and is intended for an electronic marking of at least one of a front or of a rear border of each individual receiving compartment or of a location, of the disc, which is adjacent to this receiving compartment.

20. An apparatus according to claim 17, further comprising an ejecting device which sends back coins which have not been detected satisfactorily into a hopper which feeds the disc.

21. An apparatus according to claim 17, wherein the sensing device is an inductive and/or capacitive sensing device.

22. An apparatus according to claim 17, wherein the receiving compartments have a non-circular perforation shape to stabilize a position of the coins in the receiving compartments.

23. An apparatus according to claim 22, wherein said non-circular perforation shape comprises two straight sides which converge in a direction of rotation of the disc or in a direction opposite to the direction of rotation.

24. An apparatus according to claim 17, wherein the positioning device has at least one belt, which is arranged in a region of a rotational path of the receiving compartments, is made to circulate by a motor and, based on its speed of circulation in comparison with a rotational speed of the disc in a region of the belt, has a braking or accelerating effect on the coins and thus positions the coins in the receiving compartments, in a desired position.

25. An apparatus according to claim 24, wherein the circulating belt, in a region of one side of the disc, is guided around two deflection rollers, of which at least one deflection roller is suspended resiliently such that the belt always comes into contact with the coins, irrespective of a thickness of the respective coin.

26. An apparatus according to claim 17, wherein the positioning device is a braking device.

27. An apparatus according to claim 26, wherein the braking device has a stationary brush which is arranged on one side of the disc, in a region of a movement path of the receiving compartments.

28. An apparatus according to claim 26, wherein the braking device has a leaf part which is arranged in a region of a movement path of the receiving compartments, is prestressed in a direction of the disc and/or the coins located therein, and of which a surface directed towards the coins comprises plastic or is coated with plastic.

29. An apparatus according to claim 28, wherein the leaf part is mounted in an articulated manner and is prestressed against the disc under a compressive action of a spring.

30. An apparatus according to claim 17, wherein the sensing device is a light barrier which comprises an optical transmitter and an optical receiver.

31. An apparatus according to claim 30, wherein a light beam of the light barrier is directed onto a location which is located radially within or outside a path which is described by geometrical centers of the receiving compartments of the disc.

32. An apparatus according to claim 30, wherein the computing device and the light barrier are designed for measuring along a chord of a coin positioned in the respective receiving compartment.

33. An apparatus according to claim 30, wherein the computing device and the light barrier are designed for measuring a clearance between the border of the respective receiving compartment and at least one of a front or rear border of a coin located in the respective perforation.

34. An apparatus according to claim 30, further comprising a device which defines a measuring-time window, within which measuring signals obtained from the light barrier are released for evaluation.

* * * * *